US005562551A

United States Patent [19]

Rife

[11] Patent Number: 5,562,551

[45] Date of Patent: Oct. 8, 1996

[54] IRON TYPE GOLF CLUB HEAD WITH UPPER PERIMETER WEIGHT

[76] Inventor: Guerin D. Rife, 1310 S. Pennsylvania Ave., Winter Park, Fla. 32789

[21] Appl. No.: 429,239

[22] Filed: Apr. 25, 1995

[51] Int. Cl.[6] ..... A63B 53/04

[52] U.S. Cl. ..... 473/291; 473/350

[58] Field of Search ..... 273/167 R, 77 R, 273/167 A, 167 H, 167 F, 169, 193 R, 194 R; D21/220; 473/291, 350

[56] References Cited

U.S. PATENT DOCUMENTS

| | | | |
|---|---|---|---|
| 3,059,926 | 10/1962 | Johnstone | 273/77 A |
| 3,814,437 | 6/1974 | Winquist | 273/167 H |
| 4,326,326 | 4/1982 | MacDonald | 273/169 |
| 4,420,156 | 12/1983 | Campau | 273/77 A |
| 4,621,813 | 11/1986 | Solheim | 273/77 A |
| 4,715,601 | 12/1987 | Lamanna | 273/77 A |
| 4,921,252 | 5/1990 | Antonious | 273/164.1 |
| 4,928,972 | 5/1990 | Nakanishi | 273/167 H |
| 5,048,834 | 9/1991 | Gorman | 273/167 H |
| 5,048,835 | 9/1991 | Gorman | 273/167 H |
| 5,110,131 | 5/1992 | Long | 273/167 H |
| 5,120,062 | 6/1992 | Scheie | 273/167 H |

*Primary Examiner*—Sebastiano Passaniti
*Attorney, Agent, or Firm*—Aquilino & Welsh

[57] ABSTRACT

An iron type golf club head with an improved weight distribution including a rear surface having upper and lower portions; the upper portion being defined by a rear cavity and peripheral weight and the lower portion being defined by a flat back surface.

10 Claims, 2 Drawing Sheets

IRON TYPE GOLF CLUB HEAD WITH UPPER PERIMETER WEIGHT

BACKGROUND AND SUMMARY OF THE INVENTION

The present invention relates to iron type golf club heads and more particularly to iron type club heads having an improved weight configuration.

Conventional iron type golf club heads are made in several styles notably, perimeter weighted and flat or muscle back weight configurations. Of these a number of perimeter weighted clubs provide weight at the lower or bottom surface and adjacent to the heel and toe portions of the club head. A well known perimeter weighted golf club is shown in Solheim U.S. Pat. Nos. 3,625,518, 3,655,188 and 4,621,813, among others, wherein the perimeter weight is located around the periphery of the club head.

Perimeter weighted clubs with weight distribution toward the bottom of the club head makes it easier to hit a golf ball into the air, which results in higher ball flight, particularly when a golf ball is not hit directly on the center of percussion or center of gravity. A recognized shortcoming of these clubs is a decreased level of feel, particularly to the proficient golfer. Flat back or muscle back golf clubs create increased feel when a golf ball is struck in the center of the club head, however, these clubs are unforgiving when a ball is mishit off of the center.

The present invention provides golf club heads having the features of both perimeter weight and flat back structures wherein the lower portion of the club head has a flat back configuration providing greater feel, and the upper portion of the club head has a perimeter weight configuration which produces a better shot pattern when a ball is struck off of the center of the club head.

The invention also contemplates a set of golf clubs wherein the principles of the invention are utilized wherein the weight of the club head is distributed between the heel and toe by adjusting the angle of the flat back portion of the club head. With the flat back portion angled upwardly toward the toe, there is more weight at the toe and with the angle of the flat back portion toward the heel, there is more weight in the heel area.

Among the objects of the present invention are the provision of an improved golf club head having the features of perimeter weight and flat back configurations.

Another object of the present invention is the provision of a golf club head having increased feel when a golf ball is struck on the center of the club and improved ball flight when a golf ball is mishit.

Another object of the present invention is the provision of a set of golf clubs having heel and toe weight distribution.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
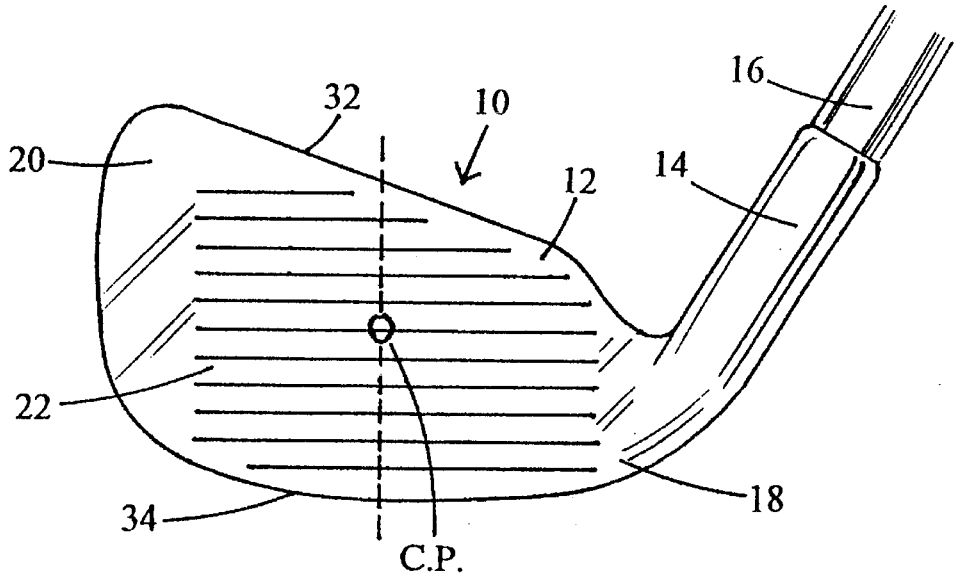
FIG. 1 is a front elevational view of an iron type golf club head in accordance with the present invention.
Figure 2:
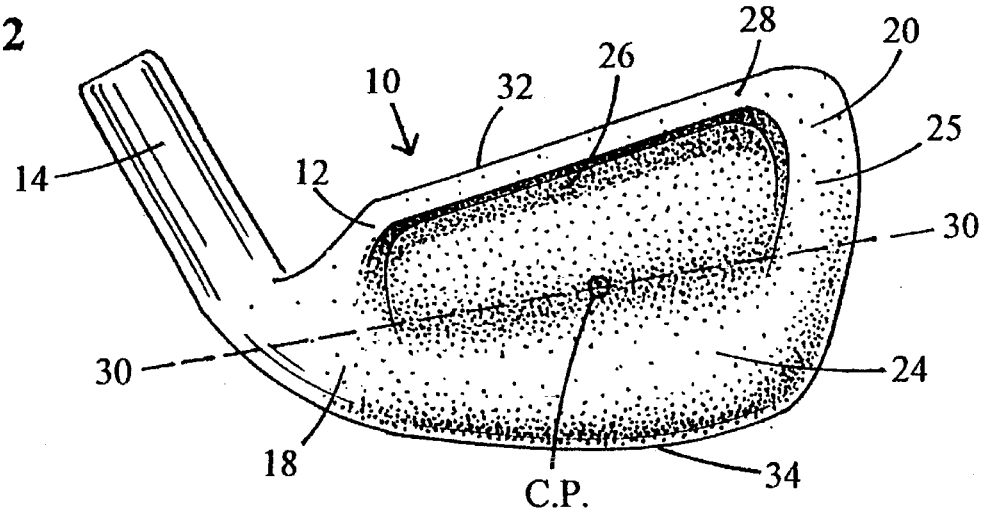
FIG. 2 is a rear elevational view of the club head of FIG. 1.
Figure 3:
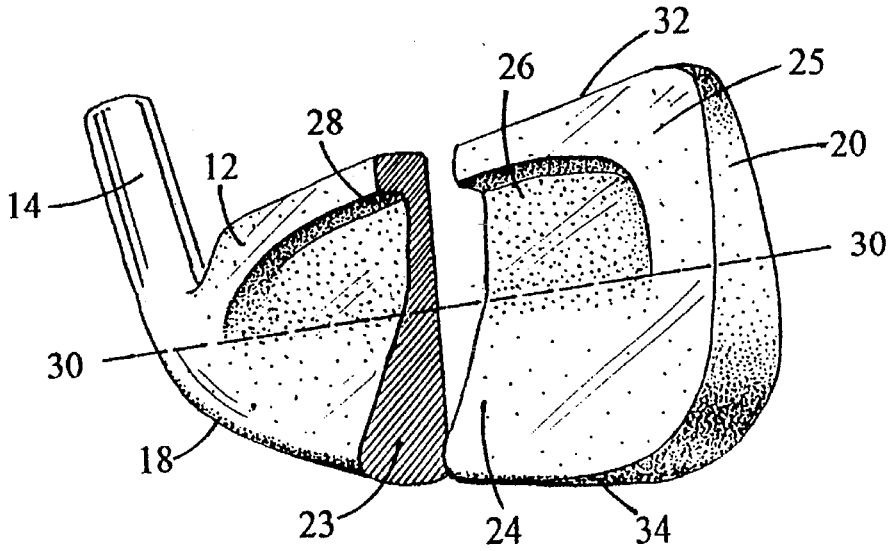
FIG. 3 is a rear perspective view of the club head of the present invention, partially in section.

Referring to the drawings, FIGS. 1, 2, and 3 show a golf club head 10 in accordance with the present invention includes a club head body 12, a hosel 14 connected to a shaft 16 and handle (not shown). The club head 10 is formed with a heel 18 and toe 20. The front of the club head 10 has a ball striking face 22 with a center of percussion CP centrally located thereon. The rear of the club head 10 is formed with a flat or muscle back lower portion 24 and an upper portion 25 defined by a cavity 26 and a peripheral weight 28. The upper portion 25 and the lower portion 24 are separated by a longitudinal axis 30 proximate a midline which bisects the rear surface area of the club head 10. The longitudinal axis 30 extends in a heel 18 to toe 20 direction approximately midway between the top ridge 32 and the bottom sole 34 of the club head 10 and is in line with the center of percussion CP. As can be seen from the drawings the upper and lower portions smoothly transition into each other providing a unique weight distribution.

The lower portion 24 is generally solid and creates a solid feel when a golf ball is struck at or near the center of percussion CP on the club head 10. Should the golf ball be mishit and struck off of the center of percussion CP, the peripheral weight 28 will minimize turning of the club head 10, due to its inherent moment of inertia thereby producing a more forgiving golf shot.

Figure 4:
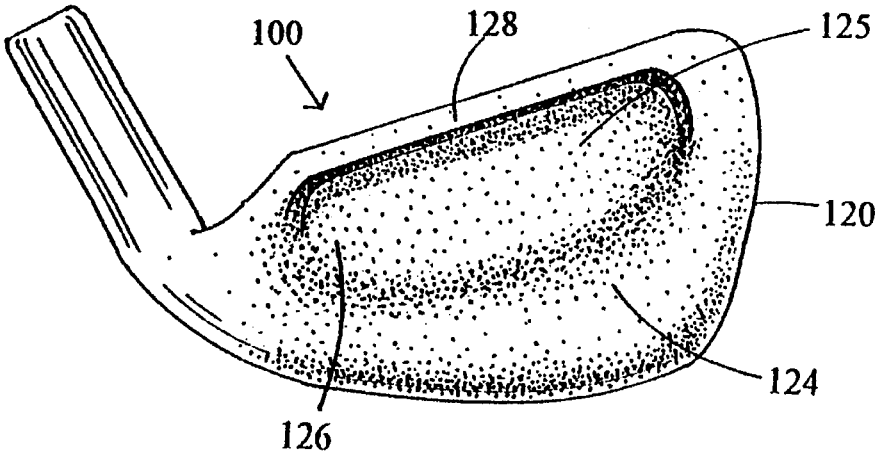
FIG. 4 is a rear view of a golf club head having the flat back portion more toward the toe.
Figure 5:
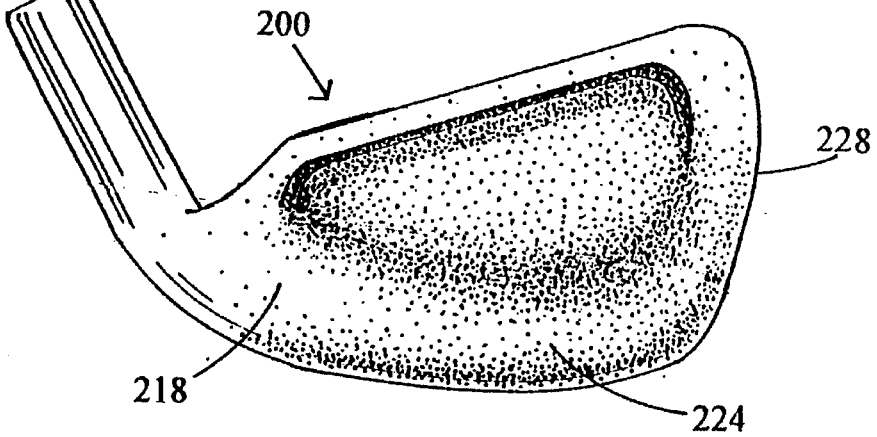
FIG. 5 is a rear view of a golf club head having the flat back portion more toward the heel.

It is generally preferable to distribute weight on a golf club toward the toe for the lower lofted irons and to distribute weight toward the heel of the club head for higher lofted irons. The weight distribution of the present invention lends itself to a set of golf club irons with these principles. Referring to FIG. 4, a golf club 100 is formed with a flat back lower portion 124 and an upper portion 125 defined by a cavity 126 and a peripheral weight 128. The lower portion 124 is angled upwardly toward a toe 120 which distributes the weight of the lower portion 124 toward the toe 120. Similarly FIG. 5 shows a golf club head 200 formed with the lower portion 224 angled toward the heel 218 distributing the weight toward the heel 218. Preferably the lower lofted irons would have weight distributed toward the toe, the middle lofted irons would have the weight evenly distributed between the heel and toe and the higher lofted irons would have the weight distributed toward the heel. However, it will be appreciated that particular golfers may prefer golf clubs wherein the weight locations differ to accommodate the players swing characteristics. For example, a golfer who generates a large amount of centrifugal force may achieve better results with a less lofted club having less weight at the toe and more near the center or even toward the heel of the club head. Also, it will be appreciated that the overall weight of each club head conform to a standard weight for a particular iron in order to maintain proper balance and swing weight characteristics.

Figure 6:
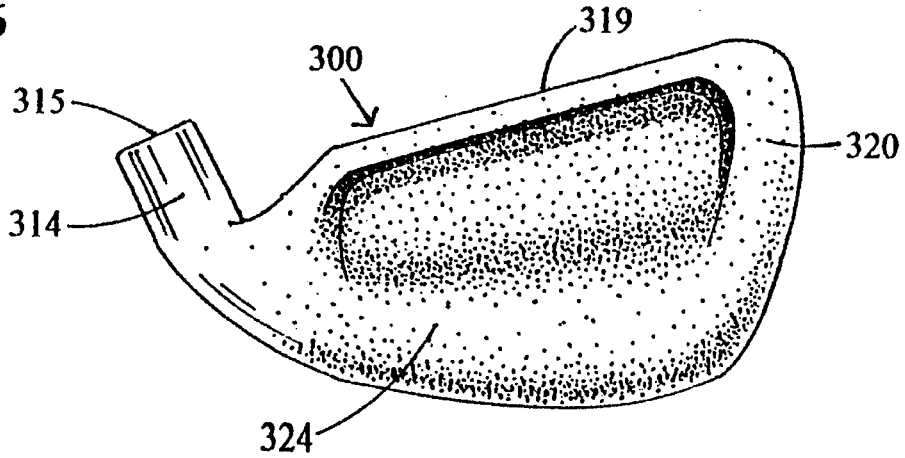
FIG. 6 is a view of another embodiment of a golf club head having a reduced size hosel.

FIG. 6 illustrates a golf club head 300 having a short hosel 314. An upper edge 315 of the hosel 314 lies below a top edge 319 of a toe 320. The club head 300 overall is structured the same as the embodiments disclosed hereinabove except the smaller hosel 314 permits a larger portion of the overall club head weight to be included in the lower portion 324 while maintaining the overall weight of the club head 300 the same.

While a preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. An iron type golf club head having a club head body, a hosel for connection to a shaft; said club head body including a heel, toe, and front surface with a ball striking face and center of percussion centrally located thereon, a top surface and a bottom surface; wherein the improvement comprises:

a rear surface having upper and lower portions; said upper portion being defined by a rear cavity and peripheral weight; said lower portion being defined by a flat back surface; said lower portion being thicker in cross-section between said front and said rear surfaces at said bottom surface, said lower portion becoming progressively thinner toward said upper surface; said peripheral weight and said cavity being located totally on said upper portion; a longitudinal midline in a heel to toe direction bisecting the rear surface of said club head, said upper portion being located above said midline and said lower portion being located below said midline; and, a smooth transition area between said upper and lower portions proximate said midline.

2. The golf club head of claim 1 being further defined by said transition area being generally parallel to said top surface and said bottom surface.

3. An iron type golf club head having a shaft connection and a club head body; said club head body including a heel, toe, front surface with a ball striking face and center of percussion located thereon; wherein the improvement comprises: a rear surface having an upper portion and a lower portion; said upper portion being defined by a cavity and peripheral weight; said lower portion being defined by a flat back surface; a longitudinal axis extending in a heel to toe direction between said upper portion and said lower portion on said rear surface, said upper portion of said rear surface being located above said longitudinal axis and said lower portion being located below said longitudinal axis; and a smooth transition area proximate said longitudinal axis between said upper portion and said lower portion.

4. The iron type golf club of claim 3 wherein said lower portion is greater in size toward said heel.

5. The iron type golf club of claim 1 wherein said hosel has an upper edge located below a top edge of said toe.

6. The iron type golf club of claim 3 wherein said lower portion is greater in size toward said toe.

7. The golf club head of claim 3 wherein said longitudinal axis is located at a midline, bisecting said rear surface.

8. A set of iron type golf club heads, each club head in said set having a club head body, a hosel for connection to a shaft; said club head body including a heel, toe, and front surface with a ball striking face; wherein the improvement comprises a rear surface on each of said club heads having upper and lower portions; said upper portion being defined by a rear cavity and peripheral weight; said lower portion being defined by a flat back surface; a longitudinal axis extending in a heel to toe direction between said upper portion and said lower portion on said rear surface; said upper portion of said rear surface being located above said longitudinal axis and said lower portion being located below said longitudinal axis; and a smooth transition area proximate said longitudinal axis between said upper portion and said lower portion and said set being further defined by a number of club heads having a greater amount of said lower portion being located toward said heel; a number of irons having a greater amount of said lower portion being located toward said toe; and a number of irons having said lower portion being evenly distributed between said heel and said toe.

9. The set of club heads of claim 8 wherein said club heads have a greater amount of said lower portion located toward said heel on club heads with higher angle lofts and said club heads have a greater amount of said lower portion located toward said toe on club heads with lower angle lofts.

10. The set of club heads of claim 8 wherein said club heads have a greater amount of said lower portion located toward said heel on club heads with lower angle lofts and said club heads have a greater amount of said lower portion located toward said toe on club heads with higher angle lofts.

* * * * *